US008658946B2

(12) United States Patent
Hodapp, Jr. et al.

(10) Patent No.: US 8,658,946 B2
(45) Date of Patent: Feb. 25, 2014

(54) CONTROL SYSTEM FOR A SELF CLEANING OVEN APPLIANCE

(75) Inventors: Leo Edward Hodapp, Jr., Louisville, KY (US); William Lee Holbrook, Goshen, KY (US); Michael Thomas Chezem, Louisville, KY (US); Michael Bernard Hitchcock, Louisville, KY (US); Philip Ames Barber, Louisville, KY (US); Jose Pintor, Queretaro (MX)

(73) Assignee: General Electric Company, Schenectady, NY (US)

( * ) Notice: Subject to any disclaimer, the term of this patent is extended or adjusted under 35 U.S.C. 154(b) by 614 days.

(21) Appl. No.: 12/891,852

(22) Filed: Sep. 28, 2010

(65) Prior Publication Data

US 2012/0074123 A1 Mar. 29, 2012

(51) Int. Cl.
*A21B 1/00* (2006.01)

(52) U.S. Cl.
USPC ..... 219/394; 219/491

(58) Field of Classification Search
USPC ..... 219/394, 483, 490–492
See application file for complete search history.

(56) References Cited

U.S. PATENT DOCUMENTS

| | | | | |
|---|---|---|---|---|
| 4,623,781 | A * | 11/1986 | Thomas | 219/413 |
| 6,157,008 | A * | 12/2000 | Brown et al. | 219/486 |
| 2004/0056015 | A1 * | 3/2004 | Barritt | 219/394 |
| 2009/0057292 | A1 | 3/2009 | Oyler et al. | |

* cited by examiner

*Primary Examiner* — Henry Yuen
*Assistant Examiner* — John Wasaff
(74) *Attorney, Agent, or Firm* — Douglas D. Zhang; Global Patent Operation

(57) ABSTRACT

A control system for an appliance having at least a first oven and a second oven includes an electronic range control device for regulating a temperature of the first oven, an electromechanical thermostat assembly for regulating a temperature of the second oven, and a relay circuit assembly under control of the electronic range control device, the relay circuit assembly being configured to selectively enable operation of the first oven and the electromechanical thermostat.

15 Claims, 6 Drawing Sheets

CONTROL SYSTEM FOR A SELF CLEANING OVEN APPLIANCE

BACKGROUND OF THE INVENTION

The present disclosure generally relates to appliances, and more particularly to a control system of a double oven cooking appliance.

Cooking appliances that feature two self-cleaning ovens generally utilize an electronic range control (ERC) to operate and regulate each of the oven cavities. Generally, a single electronic range control is used to control each oven cavity. Electronic range control devices with this capability tend to be expensive due to the added costs of the required electronic components, including for example, the relays and sensor inputs. Additionally, electronic range control devices tend to incorporate feature and option sets typically found on higher end oven models. Thus, for lower end oven appliances equipped with two self-cleaning ovens, it does not tend to be cost effective to utilize electronic range control devices to control and regulate the temperature of both ovens.

Accordingly, it would be desirable to provide a system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to a control system for an appliance that includes at least a first oven and a second oven. In one embodiment, an electronic range control device regulates a temperature of the first oven and an electromechanical thermostat assembly regulates a temperature of the second oven. A relay circuit assembly under control of the electronic range control device selectively enables operation of the first oven and the electromechanical thermostat.

Another aspect of the disclosed embodiments relates to a method in a double oven appliance that includes regulating a state of a first oven using an electronic range control, regulating a state of a second oven using an electromechanical thermostat assembly, monitoring a state of the electromechanical thermostat assembly using the electronic range control to determine the state of the second oven, and selectively enabling one or both of the first oven and the second oven when the other of the first oven or the second oven is in a pre-determined state.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
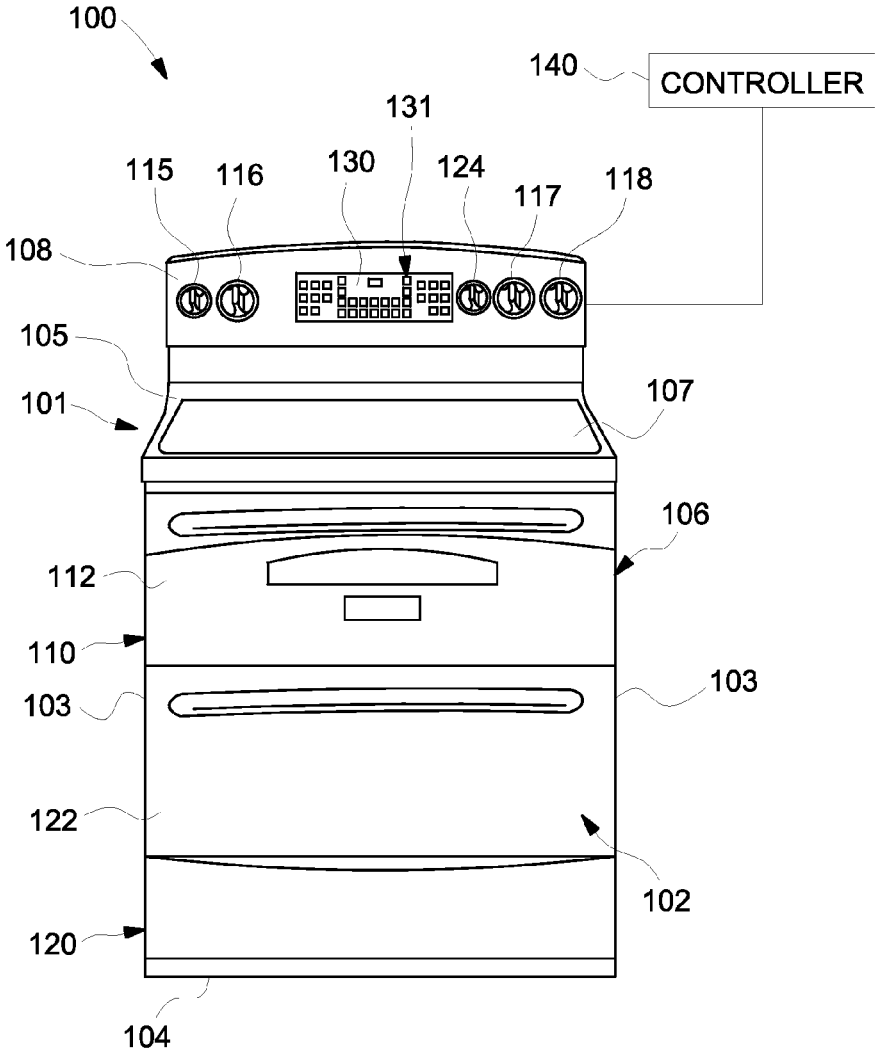
FIG. 1 is a front view of an exemplary dual-cavity oven incorporating aspects of the disclosed embodiments.

Referring to FIG. 1, an exemplary appliance such as a dual-cavity oven in accordance with the aspects of the disclosed embodiments is generally designated by reference numeral 100. The aspects of the disclosed embodiments are directed to a control system for appliance that includes two self-cleaning ovens. An electronic range control device regulates the temperature of first oven and an electromechanical thermostat assembly regulates the temperature of the second oven. The electronic range control monitors the state of the electromechanical thermostat and interlock circuitry under control of the electronic range control can prevent operation of the electromechanical thermostat assembly in certain modes of operation. The aspects of the disclosed embodiments provide for independent operation of either oven in cooking modes such as bake or broil, and dependent operation between the two ovens during self cleaning modes.

As is shown in FIG. 1, the oven 100 is generally in the form of a free-standing range or oven. The oven 100 includes a cabinet or housing 101 that has a front portion 102, opposing side panels 103, a base portion 104, a top portion 105, and a back panel 106. In one embodiment, the top portion 105 of the oven 100 includes surface heating units or burner elements, generally referred to as 107. The oven 100 also includes a first or upper oven unit 110 and a second or lower oven unit 120. The first oven unit 110 includes a first oven door 112, and the second oven unit 120 includes a second oven door 122. Each door 112, 122 can be pivoted between an open and closed position in a manner generally known.

The cabinet 101 of the oven 100 also includes control surface 108 that supports control knobs 115-118 or other suitable control switches for regulating the surface heating units 107. The cabinet 101 also includes a control panel 130 that includes a central control and display unit, also referred to as a user interface. One aspect of the control panel 130 is to control the operation of one or both of the first and second ovens 110, 120, including the modes of operation and temperature settings. The control panel 130 can include one or more controls or switches 131 that can be used to provide control inputs and commands for one or more of the functions of the oven 100. In one embodiment, the controls 131 can be in the form of push buttons, electronic switches, capacitive touch devices, pressure sensitive touch screens or near touch devices.

In one embodiment, the oven 100 includes a controller 140. The controller 140 is coupled to the control panel 130 and configured to receive inputs and commands from for example, the controls 115-118 and 131, and control the various operations and functions of the oven 100 as further described herein. In alternate embodiments, any suitable multiple oven configuration can be used.

Figure 2:
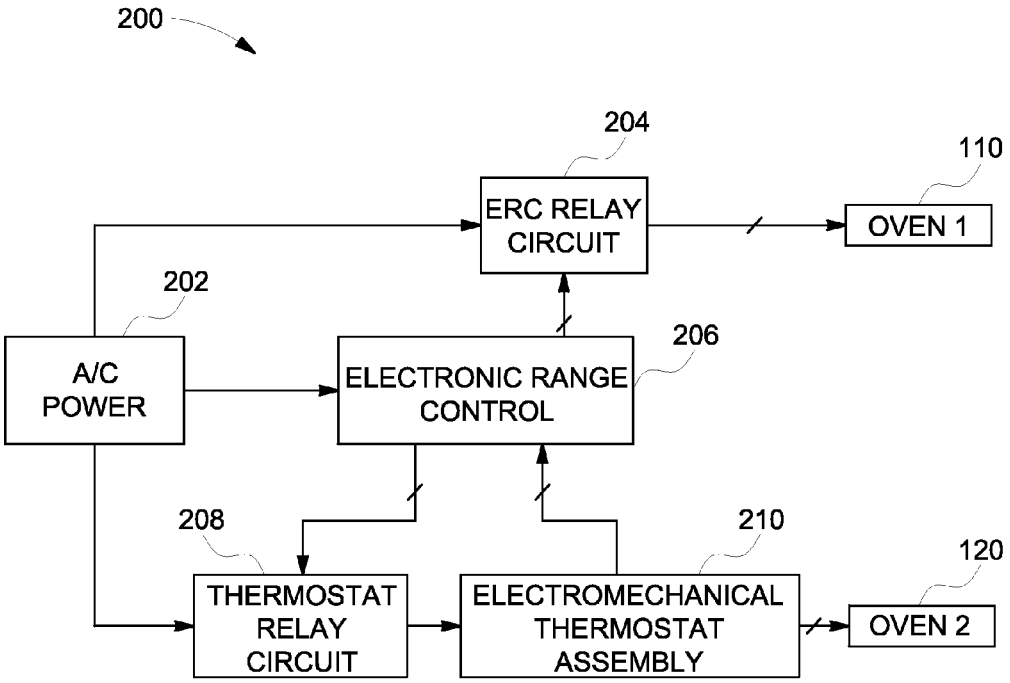
FIG. 2 is a schematic block diagram of an exemplary control system for the dual-cavity oven illustrated in FIG. 1.
Figure 6:
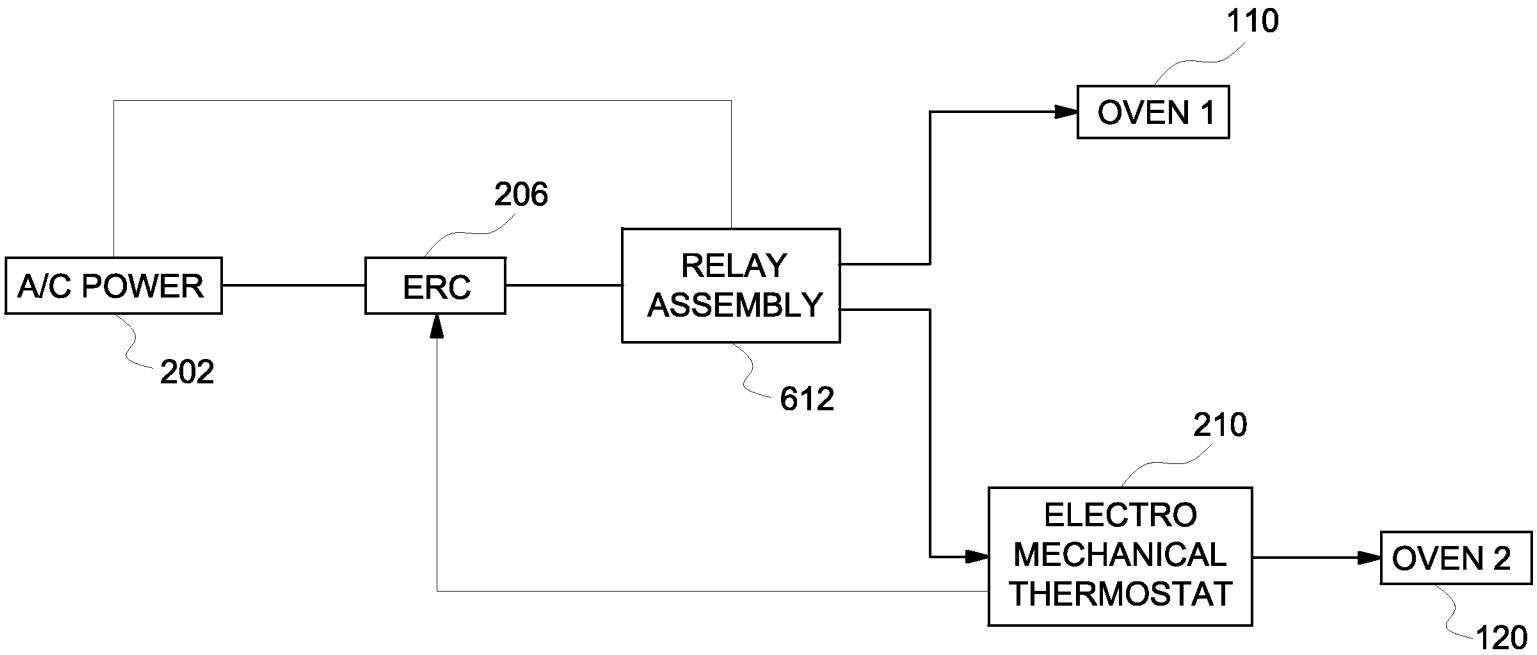
FIG. 6 is a schematic block diagram of another embodiment of an exemplary control system for the dual-cavity oven illustrated in FIG. 1.

FIG. 2 illustrates a schematic block diagram of a control system 200 incorporating aspects of the present disclosure. In one embodiment, the control system 200 can be coupled to, or incorporated with the controller 140 of FIG. 1. As is shown in FIG. 2, in one embodiment, an AC power source 202 supplies power to each of the electronic range control ("ERC") 206, ERC relay circuit 204 and thermostat relay circuit 208. Although the ERC relay circuit 204 and the thermostat relay circuit 208 are shown as separate devices in FIG. 2 for the purposes of the description herein, in one embodiment, referring to FIG. 6, the ERC relay circuit 204 and the thermostat relay circuit 208 form a single relay circuit assembly or device 612. In this embodiment, the relay circuit assembly 612 receives electrical power from AC power input 202 and is under the control of the electronic range control 206. The relay circuit assembly 612 regulates the flow of electrical power to each of the first oven 110 and the electromechanical thermostat assembly 210, as will be generally described herein with respect to FIG. 2.

The ERC relay circuit 204, which is under the control of the electronic range control 206, is configured to regulate the supply of electrical power to the first oven 110. The electronic range control 206 thus directly regulates the temperature of the first oven 110. The thermostat relay circuit 208, which is under the control of the electronic range control 206, regulates the supply of electrical power to the electromechanical thermostat assembly 210. The electromechanical thermostat assembly 210 directly regulates the temperature of the second oven 120.

As is shown in FIG. 2, in one embodiment, the electronic range control 206 is configured to selectively enable and disable each of the ERC relay circuit 204 and thermostat relay circuit 208. Generally, when the ERC relay circuit 204 is enabled, power is supplied to the first oven 110. When the thermostat relay control 208 is enabled, power is supplied to the electromechanical thermostat assembly 210. The state of the electromechanical thermostat assembly 210 determines whether power is supplied to the second oven 120.

In one embodiment, the electronic range control 206 monitors the state or mode of the electromechanical thermostat assembly 210. Generally, the states or mode of the electromechanical thermostat assembly 210 include an OFF state, a cooking state or mode and a cleaning state or mode. In one embodiment, the cooking state includes a bake or broil mode. The cleaning state includes a self-clean mode as is generally understood in the art. The electronic range control 206 will selectively enable one or both of the ERC relay circuit 204 or the thermostat control relay 208 depending on the particular state of the electromechanical thermostat assembly 210. For example, when a self-clean operation is programmed or initiated for the first oven 110, the electronic range control 206 prevents the electromechanical thermostat assembly 210 from entering certain modes of operation by disabling the thermostat relay circuit 208. For example, engaging one of the cooking modes of the electromechanical thermostat 210 is prevented when the first oven 110 or the second oven 120 is in a self clean operation. When the electromechanical thermostat assembly 210 is in a cooking mode, the electronic range control 206 will prevent the initiation of a self clean operation in the first oven 110 as well as the second oven 120. By monitoring the state of the electromechanical thermostat assembly 210, the electronic range control 206 can enable independent operation of either oven 110, 120 in cooking modes, and dependent operation of both ovens 110, 120 during self clean modes.

Figure 3:
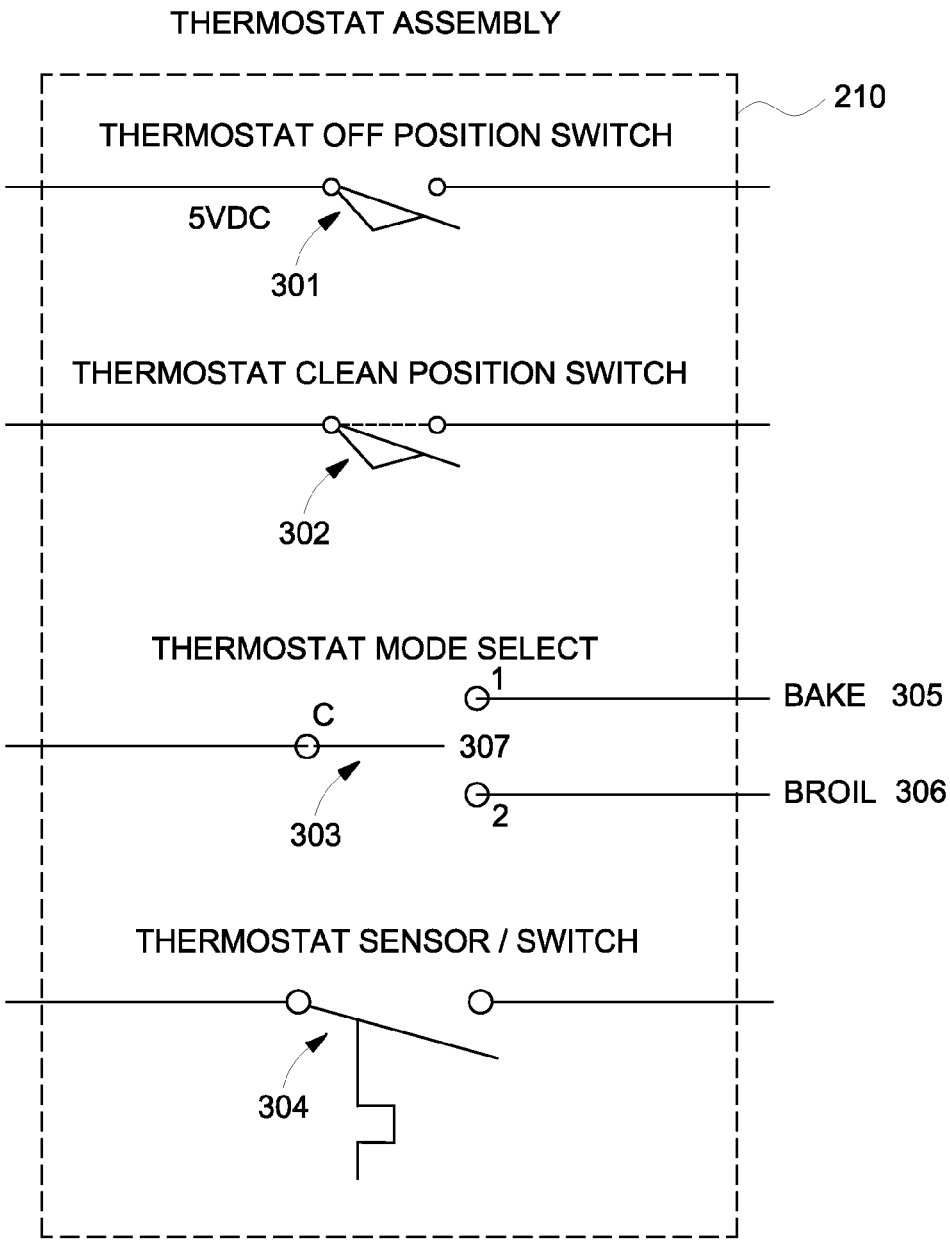
FIG. 3 is a schematic diagram of an exemplary electromechanical thermostat assembly incorporating aspects of the disclosed embodiments.

FIG. 3 illustrates one embodiment of a circuit assembly for the electromechanical thermostat assembly 210 shown in FIG. 2. As is shown in FIG. 3, the electromechanical thermostat assembly 210 generally comprises a thermostat OFF position switch 301, a thermostat clean position switch 302, a thermostat mode switch 303 and a thermostat sensor or switch 304. In one embodiment, each of the switches 301-303 is coupled to a control or selector mechanism, such as one of the control switches 131 of the control panel 130, or the selector switch 124 shown in FIG. 1. The selector switch 124 can be a knob style control where each switch 301-303 is actuated by a cam located on a shaft assembly of the selector switch 124 and are not stand-alone switches directly activated by the consumer. In alternate embodiments, the switches 301-303 can comprise any suitable control or switching mechanism.

As shown in FIG. 3, the thermostat OFF switch 301 generally comprises a limit switch, which in this example is configured to indicate when the electromechanical thermostat assembly 210 is switched OFF. In this example, the OFF mode is indicated by a closure of the thermostat OFF switch 301. Although the examples herein will generally be described with respect to a closed state of each switch indicating a selected mode, in alternate embodiments, the selection of a mode could be indicated by an open state of the switch. Thermostat clean position switch 302 is used to indicate the selection of a clean mode or cycle of the second oven 120. Thermostat mode selection switch 303, which in this example comprises a Single Pole, Double Throw (SPDT) switch, is used to indicate the selection of a cooking mode of the second oven 120. In the examples herein, the cooking mode selections can include a Bake mode selection or position 305 and a Broil mode selection or position 306, as those cooking modes are generally understood. Selection of one of the cooking modes bake or broil, via the selector switch 124 for example, indirectly actuates the thermostat mode select switch 303. In the neutral position 307 of the switch 303, neither cooking mode is selected.

The thermostat sensor or switch 304 is used to monitor a temperature of the second oven 120. In one embodiment, as is shown in FIG. 3, the thermostat sensor or switch 304 is configured to remain in a closed state or position until the monitored temperature reaches a pre-determined or set temperature. When the set temperature is reached, the state or position of the thermostat sensor 304 is open, thus opening an electrical circuit. As will generally be understood, when the set temperature for the second oven 120 is reached, the heating of the second oven 120 can be suspended until the monitored temperature drops below a pre-determined temperature. When the temperature of the second oven 120 drops below the set temperature, the temperature sensor 304 closes, thus completing an electrical circuit, heating of the second oven 120 can resume.

Figure 4:
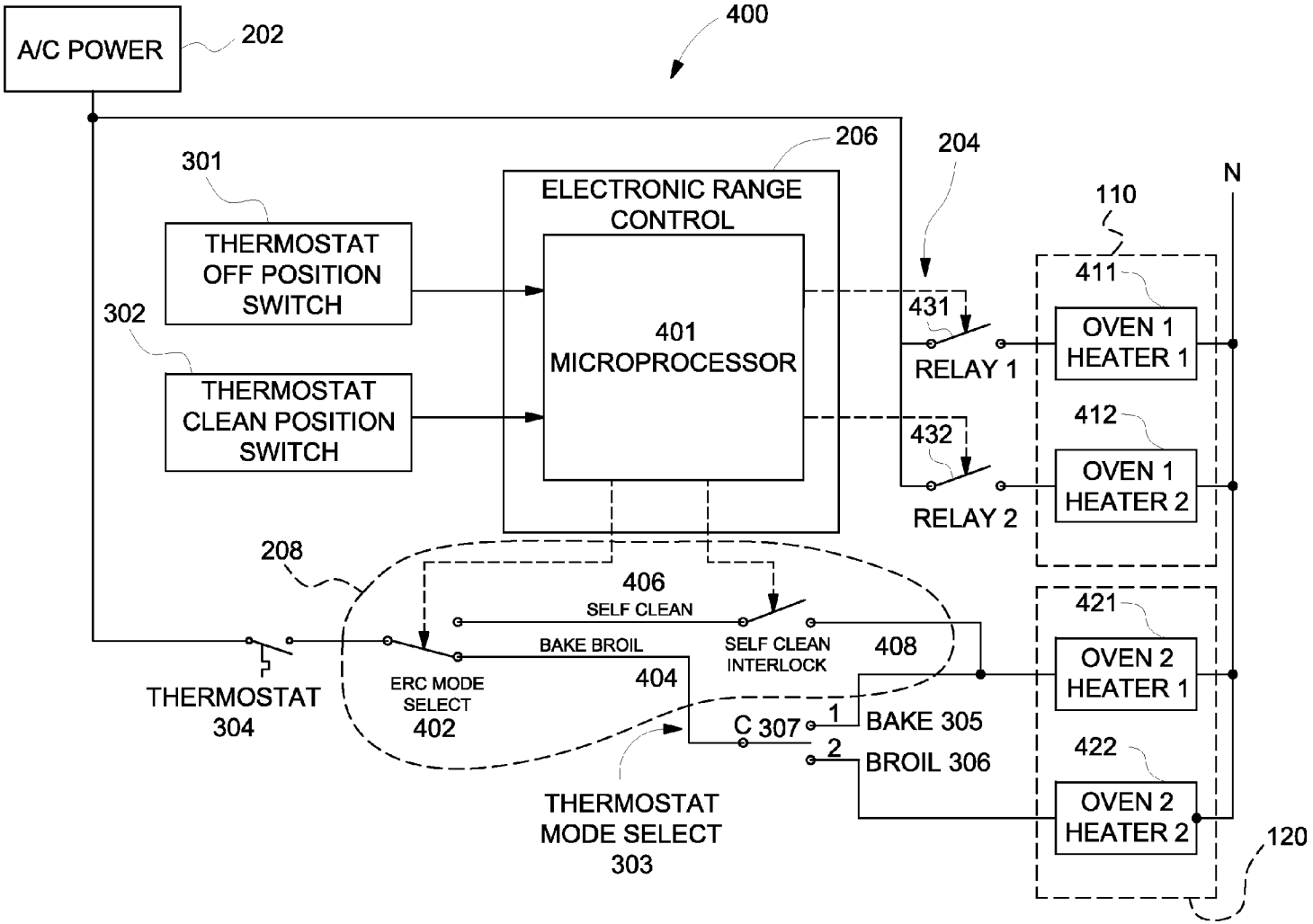
FIG. 4 is a schematic diagram of one embodiment of an electrical circuit for the control system illustrated in FIG. 2.

FIG. 4 illustrates a schematic diagram of a circuit assembly 400 for one embodiment of the control system 200 shown in FIG. 2. Relay devices 431, 432 respectively regulate the oven heaters 411 and 412, associated with the first oven 110, respectively. Relay devices 431 and 432 are under the direct control of the electronic range control 206. The oven heaters 421, 422 are associated with the second oven 120, and are indirectly controlled by the electronic range control 206, as will be described below.

In this example, the state of thermostat OFF switch 301 and the thermostat clean position switch 302 are monitored by a processor 401 in the electronic range control 206. The processor 401 is configured to control an ERC mode select relay 402, self clean interlock relay 408, as well as first oven heater relays 431 and 432. In this example, the ERC mode select relay 402 and the self-clean interlock relay 408 generally comprise the thermostat relay circuit 208 of FIG. 2. The first oven heater relays 431 and 432 generally comprise the ERC relay circuit 204.

When neither the thermostat OFF switch 301 or the thermostat clean position switch 302 is selected or closed, the electronic range control 206 generally enables the ERC relay circuit 204 and the thermostat relay circuit 208 for cooking operations of each of the ovens 110, 112. As shown in FIG. 4, the ERC mode select relay 402 includes a Bake Broil position 404 and a Self Clean position 406. When the ERC mode select relay 402 is in the Bake Broil position 404 as shown in FIG. 4, an electrical circuit is completed to allow electrical power to flow from the power source 202 to the thermostat mode switch 303, as controlled by the thermostat sensor 304. When the ERC mode select relay 402 is in the Self Clean position 406, the cooking mode or state of the second oven 120 is disabled, as electrical power cannot reach the thermostat mode switch 303. The ERC mode select relay 402 will switch to the Self Clean position when a self clean mode of the first oven 110 is activated or the thermostat clean position switch 302 is closed. Thus, if the first oven 110 is in a self clean mode and the ERC mode select relay 402 is in the Self Clean position 406, the thermostat mode switch 303 cannot enable either of the bake 305 or broil state of the oven 120.

As shown in FIG. 4, the thermostat relay circuit 208 also includes a Self Clean Interlock device 408. The Self Clean Interlock device 408 is configured to complete a circuit connection only when a self clean cycle of the second oven 120 is permitted by the electronic range control 206. When the ERC mode select relay 402 is in the Self Clean position 406, a circuit connection to enable a flow of electrical power to the second oven heater 421 is not complete unless the Self Clean Interlock device 408 is in the closed position. The conditions for permitting a self clean operation to proceed are generally understood, and can include for example, both ovens being off, or in a non-cooking mode, and both oven doors 112, 122 being in a closed and latched position.

In one embodiment, when the state of the thermostat OFF switch 301 is selected or closed, the electronic range control 206, via the processor 401 in this example, is generally configured to place the ERC mode select relay 402 in the Bake Broil state or position 402, and the Self Clean Interlock 408 in the open state or position. In this manner, the electronic range control 206 can allow cooking or self clean operations to take place in the first oven 110 by monitoring the state of the thermostat OFF switch 301.

When the clean thermostat clean position switch 302 is selected, as generally indicated by the closed position of switch 302 in this example, and the electronic range control 206 determines that the requested self clean operation is permitted, the ERC Mode select relay 402 is configured to switch to the Self Clean position 406. The closure of thermostat clean position switch 302 is generally interpreted by the electronic range control 206 as a command for the second oven 120 to initiate a self-clean operation. In one embodiment, the initiation of a self-clean operation can also include the setting of a clean time and a confirmation, through for example, the control panel 130 of FIG. 1.

In one embodiment, when the self-clean operation command is confirmed by the electronic range control 206, the self-clean interlock switch 408 is closed to provide a circuit connection to one of the heaters 421, 422. In this example, the closure of the self-clean interlock switch 408 provides a circuit connection to oven heater 421 of the second oven 120. A self-clean operation with the thermostat assembly 210 of the disclosed embodiments utilizes only one of the second oven heaters 421, 422.

In one embodiment, the electronic range control 206 monitors the clean time and provides a visual display on the control panel 130. When the time for the self-clean operation expires, the electronic range control 206 changes a state of the self-clean interlock switch 408 to the open, or disconnected position, thus interrupting the circuit connection to the heater 421. As will be generally understood, a programmed cool down takes place, until the temperature of the oven 120, as well as oven 110, is within predetermined limits to allow operation of the ovens 110 and 120 to resume. In one embodiment, during the programmed cool down, the ERC mode select relay 402 remains in the Self Clean position 406, which prevents the thermostat assembly 210 from enabling any other mode. At the end of the programmed cool down, the ERC mode select relay 402 switches back to the Bake/Broil position 404, thus re-enabling the selection of a cooking mode of operation of the oven 120.

When the clean mode is not selected, as indicated by the open state of thermostat clean position switch 302, the electronic range control 206 is configured to enable the selection of one of the cooking modes of the electromechanical thermostat assembly 210. As shown in FIG. 4, the ERC mode select relay 402 is in the Bake Broil position 404 when the thermostat clean position switch 302 is not closed. The state of the thermostat mode select switch 303 determines which of the second oven heaters 421, 422 of the second oven 120 are energized. When the thermostat mode switch 303 is set to the Bake position 305, the oven heater 421 is energized. When the thermostat mode switch 303 is set to the Broil position 306, the oven heater 422 is energized. The thermostat sensor 304 regulates the temperature of the energized heater 422.

When the first oven 110 is in a self clean operation, the electronic range control 206 will switch the ERC mode select relay 402 to the self clean position 406. This prevents a cooking mode of the thermostat assembly 210 from being engaged while the first oven 110 is in the self clean operation. The electronic range control 206 can also monitor the state of switches 301-303 to determine whether the first oven 110 can be enabled for a self-clean operation. If the second oven 120 is in a cooking mode, the first oven 110 will not be enabled for a self-clean operation until the thermostat OFF switch 301 is enabled or the thermostat mode select switch 303 is in the neutral position 307.

Figure 5:
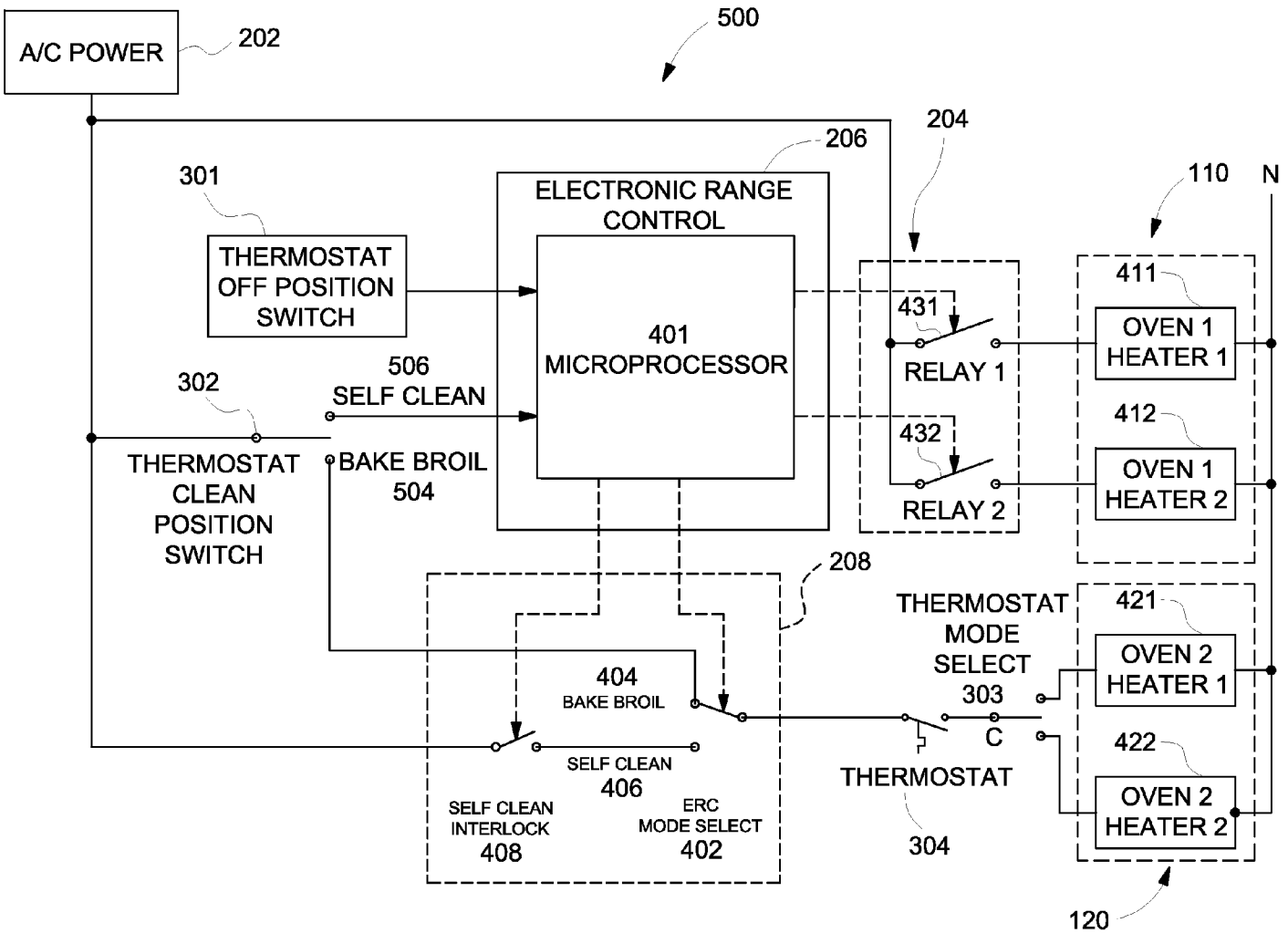
FIG. 5 is a schematic diagram of one embodiment of an electrical circuit for the control system illustrated in FIG. 2.

FIG. 5 illustrates another schematic diagram of an exemplary circuit assembly 500 for one embodiment of the control system 200 shown in FIG. 2. In this example, the thermostat sensor 304 is electrically positioned between the ERC mode select relay 402 and the thermostat mode switch 303. The self-clean interlock 408 is electrically positioned between the AC power source 202 and the ERC mode select relay 402. In this example, both the self-clean interlock 408 and ERC mode select relay must be in the self clean position or mode in order to complete the circuit connection between the AC Power source 202 and the thermostat sensor 304 in a Self Clean mode.

The thermostat clean position switch 302 is this embodiment is a SPDT switch that is configured to create a circuit connection between the AC power 202 and one of the Bake/Broil switch position 504 or the Self-Clean switch position 506. When the thermostat clean position switch 302 is in the Bake/Broil position 504 and the ERC mode select relay 402 is switched to the Bake/Broil position 404 and a circuit connection is established between the AC Power Source 202 and the thermostat sensor 304.

The disclosed embodiments may also include software and computer programs incorporating the process steps and instructions described above. In one embodiment, the programs incorporating the process described herein can be stored on or in a computer program product and executed in one or more computers. The controller 140 illustrated in FIG. 1 can include computer readable program code means stored on a computer readable storage medium, such as a memory for example, for carrying out and executing the process steps described herein. In one embodiment, the computer readable program code is stored in a memory of the controller 140. In alternate embodiments, the computer readable program code can be stored in memory or memory medium that is external to, or remote from, the controller 140. The memory can be direct coupled or wireless coupled to the controller 140.

The controller 140 may be linked to another computer system or controller (not shown), such that the controllers are capable of sending information to each other and receiving information from each other. In one embodiment, the controller 140 could include a server computer or controller adapted to communicate with a network, such as for example, a wireless network or the Internet.

The controller 140 is generally adapted to utilize program storage devices embodying machine-readable program source code, which is adapted to cause the controller 140 to perform the method steps and processes disclosed herein. The program storage devices incorporating aspects of the disclosed embodiments may be devised, made and used as a component of a machine utilizing optics, magnetic properties and/or electronics to perform the procedures and methods disclosed herein. In alternate embodiments, the program storage devices may include magnetic media, such as a diskette, disk, memory stick or computer hard drive, which is readable and executable by a computer. In other alternate embodiments, the program storage devices could include optical disks, read-only-memory ("ROM") floppy disks and semiconductor materials and chips.

The controller 140 may also include one or more processors, such as processor 401, for executing stored programs, and may include a data storage or memory device on its program storage device for the storage of information and data. The computer program or software incorporating the processes and method steps incorporating aspects of the disclosed embodiments may be stored in one or more computer systems or on an otherwise conventional program storage device.

The aspects of the disclosed embodiments provide a low cost control solution for a cooking appliance equipped with two self-cleaning ovens by using an electronic range control for regulating the temperature of the first oven and an electromechanical thermostat assembly for regulating the temperature of the second oven. Interlock circuitry under control of the electronic range control can prevent operation of the electromechanical thermostat assembly in certain modes of operation.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A control system for an electronically controlled range including at least a first oven and a second oven, the control system comprising:

an electronic range control device for the electronically controlled range and configured to regulate a temperature of the first oven;

an electromechanical thermostat assembly configured to regulate a temperature of the second oven; and a relay circuit assembly coupled between the electronic range control device and the first oven, and between the electronic range control device and the electromechanical thermostat assembly, and configured to selectively enable operation of the first oven and the electromechanical thermostat assembly, the relay circuit assembly being controlled by the electronic range control device.

2. The control system of claim 1, wherein the electronic range control device is configured to enable operation of one of the first or second oven only when the other of the first or second oven is in certain pre-determined modes of the electronically controlled range.

3. The control system of claim 1, wherein the relay circuit assembly comprises a electronic range control relay circuit assembly and a thermostat relay circuit assembly, the electronic range control relay circuit assembly being coupled to the first oven and the thermostat relay circuit assembly being coupled to the electromechanical thermostat assembly.

4. The control system of claim 3, wherein the thermostat relay circuit assembly enables operation of the electromechanical thermostat assembly only when the first oven is not in a self-clean mode.

5. The control system of claim 3, wherein the thermostat relay circuit assembly is configured to switch between a cooking mode and a self-clean mode.

6. The control system of claim 3, wherein the electromechanical thermostat assembly comprises a thermostat clean mode select switch coupled to the electronic range control device and configured to initiate a self clean command to the electronic range control device.

7. The control system of claim 6, wherein the electronic range control device is configured to switch the thermostat relay circuit assembly to a self clean mode when the self clean command is confirmed.

8. The control system of claim 3, wherein the thermostat relay circuit assembly prevents operation of the electromechanical thermostat assembly when the first oven is in a self-clean mode.

9. The control system of claim 1, wherein the electromechanical thermostat assembly comprises a thermostat clean mode selection switch, the thermostat clean mode selection switch being coupled to the electronic range control device, and wherein the electronic range control device is configured to prevent a start of an operation of the first oven when a state of the thermostat clean mode switch is enabled.

10. The control system of claim 1, wherein each of the first oven and the second oven operates dependently when each oven is in a cooking mode, and dependently when one of the first or second ovens is in a self-clean mode.

11. The control system of claim 1, wherein the electromechanical thermostat assembly is enabled for operation by the electronic range control device only when the first oven is not in a self-clean mode.

12. A method in an electronically controlled double oven range, comprising:

regulating a state of a first oven of the double oven using an electronic range control of the electronically controlled range;

regulating a state of a second oven of the double oven using an electromechanical thermostat assembly;

monitoring a state of the electromechanical thermostat assembly using the electronic range control to determine the state of the second oven; and using a relay circuit assembly coupled between the electronic range control and the first oven, and between the electronic range control and the electromechanical thermostat assembly to selectively enable one or both of the first oven and the second oven when the other of the first oven or the second oven is in a pre-determined state.

13. The method of claim 12, further comprising monitoring a state of a clean position switch in the electromechanical thermostat assembly and enabling the first oven only when the clean position switch is not in an enabled state.

14. The method of claim 13, further comprising monitoring a state of an OFF position switch in the electromechanical thermostat assembly and enabling a self clean operation in the first oven when the state of the OFF position switch is not enabled and the state of the clean position switch is not enabled.

15. The method of claim 12, further comprising enabling selection of a cooking mode of the electromechanical thermostat assembly when the first oven is not in a self clean mode.

* * * * *